United States Patent [19]

Scarpitti

[11] 4,241,241

[45] Dec. 23, 1980

[54] ELECTROMECHANICAL RECORD DISK DYNAMIC RANGE EXPANDER

[75] Inventor: Roger V. Scarpitti, Akron, Ohio

[73] Assignee: Janice K. Scarpitti, Akron, Ohio

[21] Appl. No.: 961,867

[22] Filed: Nov. 20, 1978

[51] Int. Cl.[3] ..... H04R 11/12

[52] U.S. Cl. ..... 179/100.41 Z; 179/100.41 K; 274/37

[58] Field of Search ..... 179/100.41 K, 100.41 Z, 179/100.41 D, 100.41 M; 274/37

[56] References Cited

U.S. PATENT DOCUMENTS

| | | | |
|---|---|---|---|
| 3,904,837 | 9/1975 | Sugimoto et al. | 179/100.41 K |
| 3,908,096 | 9/1975 | Furuya | 179/100.41 Z |
| 3,988,025 | 10/1976 | Nagamura | 179/100.41 K |
| 4,004,108 | 1/1977 | Kurata | 179/100.41 K |
| 4,054,758 | 10/1977 | Fidi | 179/100.41 K |
| 4,075,418 | 2/1978 | Nemoto et al. | 179/100.41 K |
| 4,093,833 | 6/1978 | Tsukamoto | 179/100.41 D |
| 4,103,117 | 7/1978 | Morinaga | 179/100.41 K |

*Primary Examiner*—Bernard Konick
*Assistant Examiner*—Donald McElheny, Jr.

[57] ABSTRACT

An electromechanical record disk dynamic range expander for use in a stereophonic system. The invention includes a pivotally mounted stylus-bearing shank. Received within the shank are iron inserts which are maintained opposite electromagnetic coils and extended pole pieces. A permanent magnet communicates with the iron inserts by means of a steel fulcrum, and communicates with the extended pole pieces by means of a steel canister receiving the assembly as a whole. The coils are maintained between respective pairs of extended pole pieces and iron inserts, and are wound in such a manner that the number of coil windings increases with distance from the coil centerline. A magnetic gap exists between the extended pole pieces and associated iron inserts, with the respective coils being received within such magnetic gap. Movement of the stylus in a record groove causes the magnetic gap of the associated channel to move, cutting the coil windings and inducing a signal corresponding to the stored tonal image. The coil winding technique results in amplified increases in coil signal strength for linearly increasing mechanical movement of the stylus, achieving dynamic range expansion.

19 Claims, 4 Drawing Figures

ELECTROMECHANICAL RECORD DISK DYNAMIC RANGE EXPANDER

BACKGROUND OF THE INVENTION

The instant invention resides in the art of stereo sound apparatus, and more particularly in that of stereo generators and dynamic range expanders.

In recent years, there has been a great increase in the popularity of stereo sound systems for retrieving the tonal image stored upon the modulation sidewalls of a record groove. With the increase in popularity has come a number of attempts to sophisticate and refine such stereo systems to improve channel separation, noise suppression, frequency response, and the like. Indeed, in U.S. Pat. No. 3,040,136, to J. F. Grado, a number of advances were made in the art. In applicant's own copending patent application Ser. No. 949,742, for "STEREO CARTRIDGE," filed Oct. 10, 1978, still further improvements in the art have been set forth. The structure of the instant invention yet further advances the art beyond the point to which it has been taken by the teachings of Grado and those of applicant's referenced application.

In the prior art, other stereo systems have customarily emitted a low level sound known as "record hiss," particularly when the volume of the stereo amplifier has been increased to enhance loud sounds. Record hiss is a low level sound, but with the increase in amplifier volume, the hiss is accentuated and becomes audible to the discerning listener. Yet further, low level harmonics of the tonal image recovered by the stereo system from the record have often been lost in present systems utilizing an armature for saturating electromagnetic coils with magnetic flux. Such armatures have had a tendency to magnetize with time and to thus maintain a residual magnetization in the range actuated by low level harmonics. With an existing threshold of residual magnetization upon the armature, the coils have been incapable of responding to or recognizing low level harmonics from the tonal image.

In the prior art, other problems have existed with the general mechanical structure of the stereo pick-up cartridge and generator. Indeed, there are no known systems, apart from applicant's own, which utilize a shank assembly and associated moving generating elements which may be readily removed from a cartridge assembly and be easily replaced without the need for special tooling and the like. Heretofore, such removal has generally resulted in the costly discarding of the stereo pick-up itself and the subsequent total replacement of the same.

Additionally, known systems have generally been ineffective in optimizing full frequency bandwidth channel separation, but have allowed cross-talk between channels without reliably correlating the mechanical modulation of the sidewall of a record groove with the associated output channel of the stereo system.

Additionally, known systems have required sophisticated and expensive add-on equipment to achieve dynamic range expansion or enhancement. All known dynamic range expanders have been totally electronic in nature and there are no known electromechanical assemblies and particularly no such assemblies which may be found directly within a cartridge or pick-up other than that taught by applicant's copending patent application.

The vast majority of stereo cartridge generators known to applicant utilize elastomers as fulcrums for the moving iron or moving magnet signal inducers of the stereo pick-up. Such elastomers inherently result in audible distortion since such elastomers subject the fulcrum to random mispositioning. Hence, response of the signal inducer attached thereto is not a true electrical reproduction of the tonal modulations stored within the stereo record grooves.

OBJECTS OF THE INVENTION

In light of the foregoing, it is an object of the instant invention to provide an electromechanical record disk dynamic range expander which is capable of squelching record hiss by including the characteristics of a dynamic range expander within the pick-up itself, alleviating the necessity of increasing amplifier volume or adding additional electronic components to the stereo system.

Another object of the invention is to provide an electromechanical record disk dynamic range expander which is capable of mechanically responding to low level harmonics of the tonal content stored within the record grooves and producing the electrical complement of the same by providing a pick-up which utilizes no armatures but includes stationary coils.

Still another object of the invention is to provide an electromechanical record disk dynamic range expander which includes a generator which may be removed for service or replacement without the necessity of specialized tools or knowledge.

Yet an additional object of the invention is to provide an electromechanical record disk dynamic range expander which provides superior channel separation over systems presently known in the art.

A further object of the invention is to provide an electromechanical record disk dynamic range expander wherein the fulcrum for stylus motion is a machined fulcrum, not susceptible to cocking, misalignment, and non-homogeneous characteristics of presently used elastomer fulcrums.

Still a further object of the invention is to provide an electromechanical record disk dynamic range expander which is simplistic in construction, reliable in operation, readily producible from state-of-the-art apparatus, conducive to implementation with presently existing stereo systems, and one which may be manufactured on a cost-effective basis.

SUMMARY OF THE INVENTION

The foregoing and other objects of the invention which will become apparent as the detailed description proceeds are achieved by an electromechanical record disk dynamic range expander, comprising: a shank having a stylus depending from a first end thereof; first magnetic flux conducting elements received within said shank at a second end therof; pivot means operatively connected to said second end of said shank for allowing said shank to pivot about a point; a magnet; second magnetic flux conducting elements operatively connected to said magnet and positioned opposite said first magnetic flux conducting elements; and a plurality of coils interposed between pairs of said first and second magnetic flux conducting elements.

DESCRIPTION OF THE DRAWING

For a complete understanding of the objects, techniques, and structure of the invention, reference should be had to the following detailed description and accompanying drawing wherein.

DETAILED DESCRIPTION OF PREFERRED EMBODIMENT

Figure 1:
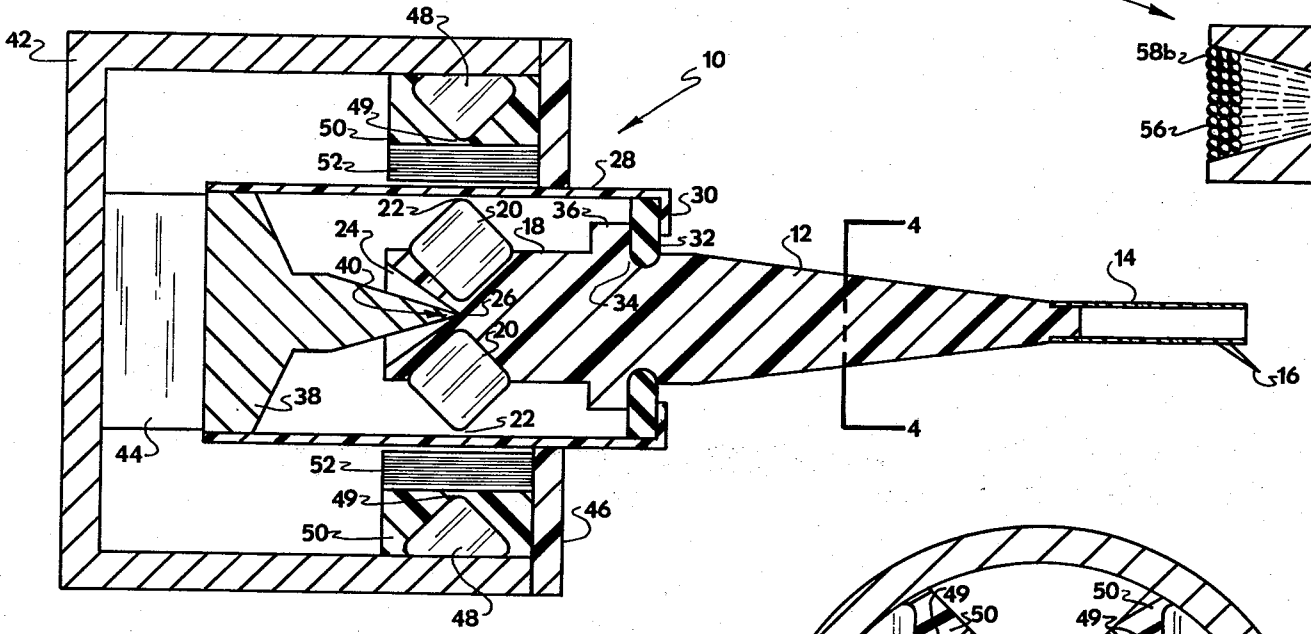
FIG. 1 is a cross-sectional view of the stereo generator assembly of the invention taken at a 45° angle with respect to the plane formed by the stylus and main axis of the shank.
Figure 4:
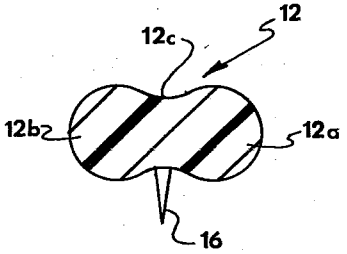
FIG. 4 is a cross-sectional view of the stylus of the invention taken along the line 4—4 of FIG. 1.

Referring now to the drawing and more particularly FIG. 1, it can be seen that a stereo generator assembly in accordance with the teachings of the invention is designated generally by the numeral 10. The assembly includes an elliptically oval shank 12, preferably of ferrous oxide-impregnated styrene, which is of a circular cross-section at the ends thereof. An aluminum tubular section 14, circular in cross-section, is affixed to the smaller end of the shank 12. Connected to and depending from the tubular section 14 is a suitable stylus or needle 16. The elliptically oval shank 12 and tubular member 14, and the benefits thereof, are more fully discussed in the aforementioned copending patent application Ser. No. 949,742. However, as shown in FIG. 4, the shank 12 is not truly elliptical as in the copending patent application, but is shaped in cross-section like a dog bone. Two outer substantially circular sections **12*a*, 12*b* are interconnected by a narrower midsection 12*c*. Such a design reduces the mass of the shank 12, while directing the plastic resonance frequencies of the record groove to a horizontal plane. With the shank 12 secured in the horizontal plane between the record groove and the pivot point 40, to be discussed later, the plastic resonances are damped by the shank itself in the manner discussed in the referenced copending patent application. Further, and as apparent from FIG. 1, the shank 12** tapers from a large circular cross-section at one end to a smaller circular cross-section at the other, being of the elliptical nature in between as shown in FIG. 4.

For purposes of better understanding the structure of FIG. 1, it should be noted that the axis of the stylus 16 and the longitudinal axis of the shank assembly 12, 14 define a plane which forms a 45° angle with the sheet of FIG. 1. An appreciation of such relationship is important for a complete and proper understanding of the moving magnetic gap technique to be discussed hereinafter. The shank 12 has, at an end opposite the end of circular cross-section, a cubical block portion 18 adapted for receiving iron inserts 20. The inserts 20 may be molded into the plastic cubical portion 18 and are preferably shaped like an acorn, substantially spherical in nature while coming to a rounded point 22. The end of the cubical portion 18 is characterized by a conical recess 24, having an apex 26. As will be discussed hereinafter, there are four iron inserts 20 in the preferred embodiment of the invention with the same being aligned such that the rounded points 22 of each of the four inserts 20 define a plane containing the apex 26. The importance of such arrangement will become apparent hereinafter.

A cylindrical housing 28 is provided for receiving and maintaining the mechanically movable elements of the assembly 10. The housing 28 is substantially open at a rear end thereof, while being partially closed by means of an annular ring or flange 30 at the front end thereof. Preferably, the housing 20 is made of plastic, and the flange 30 may be molded as part and parcel of the housing proper. This flange 30 provides a surface for abuttment with the pivot pressure and compliance elastomer 32, which is of an annular nature and received by the circumferential groove 34 provided about the shank 12. Further maintaining the elastomer 32 in position is a compliance pressure rib or disk 36 which may be molded as part and parcel of the shank 12 or otherwise positionally affixed thereto. Again, the function and benefit of the elements 32–36 may be appreciated by reference to copending patent application Ser. No. 949,742.

With the housing 28 having an open rear end, the shank 12, having the elastomer 32 received in the groove 34, may be passed through the opening of the annular ring 30 until the elastomer 32 makes compressive engagement between the ring 30 and the rib 36. At this point in time, a steel base member 38 may be press-fit into the open end of the housing 28 such that the point 40 is received by the apex 26. Such engagement further comprises the compliance elastomer 32 between the rib 36 and flange 30. The contact established between the point 40 and the apex 26 defines the pivot point for movement of the magnetic gap as will be discussed hereinafter. With proper machining of the conical recess 24 and the point 40, the defined pivot point becomes substantially friction free, with such characteristics being further enhanced by a lubricant coating such as that manufactured under the trademark "TEFLON."

The assembly 10 is further defined by a canister 42 manufactured of steel or other suitable material capable of conducting magnetic flux. A permanent magnet 44 is centrally received by the bottom of the canister 42 and may be secured thereto solely by the magnetic attraction for the steel bottom, or by an appropriate adhesive or the like. The canister 42 is partially closed at an opposite end by means of a plastic end cap 46 which is of an annular nature, having an opening axially aligned with the magnet 44. The cap 46 may be cemented or otherwise secured to the rim of the canister 42.

Received within the canister 42 and abutting the cap 46 are extended pole pieces 48 comprising mounds of steel or other magnetic flux conducting material. The extended pole pieces 48 are complementary to the exposed portions of the inserts 20, having rounded points 49 positioned opposite associated rounded points 22. Mounted atop the pole pieces 48 are plastic coil mount fixtures 50 which, in turn, receive associated coil forms 52.

It should now be appreciated that there is provided a number of closed magnetic paths between the magnet 44, the steel canister 42, pole pieces 48, coil mounts 50, coil forms 52, iron inserts 20, and the steel base member 38. It should further be noted that the cylindrical housing 28 is held within the canister 42 by the magnetic attraction between the magnet 44 and base member 38. The shank assembly and iron inserts are maintained within said housing by means of compressive engagement via the elements 32, 36, 38. The canister 28 may be simply withdrawn from the annular opening of the cap 46, overcoming the magnetic attraction between the elements 44, 38 for service or replacement of that portion of the generator assembly 10. It will also be noted that the rounded points 22 of the inserts 20 form a plane which not only contains the point 26, but also maintains the central axes of the disk-like elements 46–52.

Figure 2:
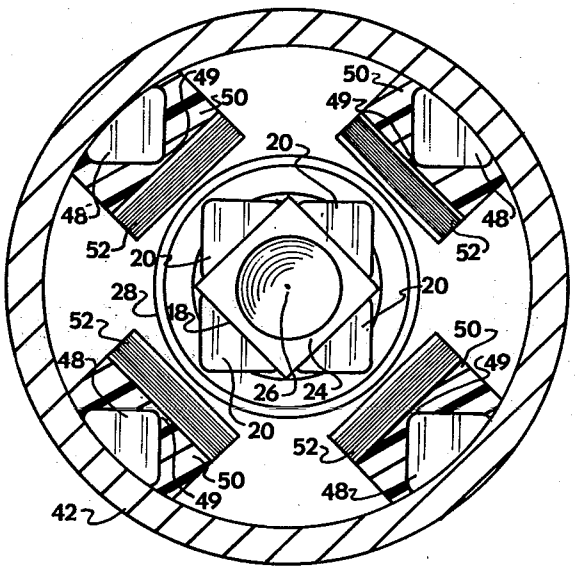
FIG. 2 is an end view of the assembly of FIG. 1 with the end of the canister, magnet, and fulcrum assembly removed.

With particular reference to FIG. 2, it can be seen that the block end portion 18 of the shank assembly receives four iron inserts in 90° spaced relationship to each other. Each of the inserts 20 has associated therewith corresponding elements 48–52 in the manner described previously. The inserts 20 and the coils of the coil forms 52 are connected in pairs, one pair associated with each channel or sidewall of the stereo record groove. As shown in FIG. 2, those coils diametrically opposite each other form such pairs. It will be further understood that the stylus 16, at the end of the shank 12, is aligned with the vertical diagonal of the cubical block 18. Hence, the axes of the paired elements 20, 48–52 form a 45° angle with the vertical and with the record surface when the stylus 16 is placed thereupon, such that each such pair is uniquely aligned with an associated sidewall of the record modulation groove. It will also be appreciated that as the stylus 16 is caused to move by a sidewall of the record groove, the iron inserts 20, aligned with that sidewall, are caused to tilt by the pivoting movement at the apex 26. The other pair of inserts 20 merely rotates about the axis common to the pair and passing through the apex 26 and the center of the associated assemblies 48–52.

Figure 3:
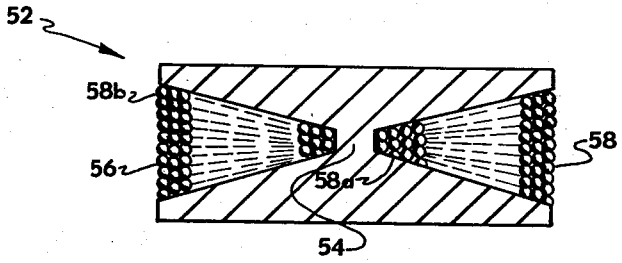
FIG. 3 is a cross-sectional view of the coil forms of the invention showing the linearly progressive coil windings thereon.

With reference now to FIG. 3, it can be seen that the coil form 52 is a spool substantially comprising two cones interconnected by a spindle 54. Near the center of the spool, at the spindle 54, there is provided a small cross-sectional area which increases in size to the outer area 56. This area is adapted for receiving wire 58 wound upon the spool. It will be seen that the coil form 52, wrapped with wire 58, provides an increasing number of coil turns with increasing distance from the central axis of the form itself. Of course, the rate of change of number of turns of wire with respect to distance from the central axis may be varied by varying the angle of the cones attached to the spindle 54 which define the wire-receiving area. The ends of the wire **58*a*, 58*b* may be connected to appropriate amplifiers of the stereo system in standard fashion, diametrically opposed coil assemblies 52** being connected to the same amplifier channel.

In the assemblies shown in FIGS. 1 and 2, the coil forms 52 are positioned such that the axis of the spindle 54 of paired coils 52 are in line and pass through the central axis of associated iron inserts 20 and the apex 26. As the stylus 16 tracks in a record groove, the associated iron inserts 20 tilt. This tilting or mechanical modulation moves the magnetic field across the wires 58 of the coils 52. This moving magnetic field cuts the wires and induces a voltage thereinto, such voltage being transmitted to associated amplifiers for transmission to a speaker system where the output sounds are evidenced. It should be noted in the generator assembly 10 that there is no moving magnet, nor is there an armature for the coil 52, with the coil form itself being constructed of plastic or the like. However, there is a moving magnetic field created in the gap between the extended pole pieces 48 and iron inserts 20. Small movements of the stylus 16 result in minor tilts of the inserts 20 with only a few coils of wire 58 being cut by the magnetic field. Greater movements of the stylus 16 result in greater movement of the magnetic field where even more wires 58 are cut. Correspondingly, the voltage induced for translation into sound is increased.

Before entering into a detailed description of the operation and benefits of the invention, it should be noted that the iron inserts 20 are preferably of a size having a major axis of 0.025 inches. Each coil pair has 1,000 turns of wire 58, 500 turns per coil, with such wire 58 having a diameter of 0.0006 inches. It should therefore be readily appreciated that the spool 52 is approximately the size of the head of a pin.

As the stylus 16 tracks a record groove, the mechanical movement is translated to the iron inserts 20 by the pivoting of the cubical block 18 about the apex 26. While moving along one sidewall of the record groove, the associated paired inserts 20 tilt, moving the magnetic gap between the inserts 20 and the extended pole pieces 48 to cut the wires 58 of the associated coil 52. The magnetic field is more concentrated between the rounded points 22 of the inserts 20 and the rounded points 49 of the extended pole pieces 48 which are centrally aligned with the pivot point of the apex 26, the spindle 54 of the coil 52, and the rounded points 49 of the extended pole pieces 48. While the one pair of inserts 20 is tilting, the other pair of inserts 20 is rotating about its axis passing through the apex 26. Such rotation results in no flux motion and, hence, no induced voltage at any frequency. Consequently, an output is only experienced from the opposite channel. As the iron inserts 20 are caused to move progressively more, the moving magnetic field progressively cuts more and more turns of wire due to the nature of the coil form 52. In other words, the further the inserts 20 swing the magnetic field across the center of the spindle 54, the progressively greater the number of turns of the coil that are cut by the moving magnetic field and, correspondingly, the greater the output signal level from that coil pair to the amplifier. Thus, the coils evidence an accelerated progressively increasing output response to linearly increasing inputs of the mechanical stimulus provided by the modulation of the stylus 16 in the record groove. Thus, soft sound levels (lower induced signal voltage) are made softer while loud sound levels (higher induced signal voltage) are made louder. There is thus provided a mechanical dynamic range enhancer maintained as the generator assembly itself, comprising a part of parcel of the coil assembly.

It should also be appreciated that the precise alignment of the center lines of the elements 20, 52 with respect to the apex 26 results in a superior channel separation. Such arrangement allows one set of iron inserts 20 to cause the magnetic field to cut the coil wires 58 during a tilt while the other set of inserts 20 rotates, resulting in no magnetic flux motion across the coil wires. Further, channel separation is enhanced by the mere provision of the coil winding technique shown in FIG. 3. By enhancing high level outputs with respect to low level outputs, channel separation is optimized in that the listener has a definite appreciation for a responding signal changing volume level in the listening depth dimension.

Thus it can be seen that the objects of the invention have been satisfied by the structure presented hereinabove. While in accordance with the present statutes only the best mode and preferred embodiment of the invention has been presented and described in detail, it is to be understood that the invention is not limited thereto or thereby. Consequently, for an apprecation of the true scope and breadth of the invention, reference should be had to the following claims.

What is claimed is:

1. A stereo cartridge comprising;

a shank having a stylus depending from a first end thereof;

flux conducting element retaining means at a second end thereof which means provides a recess point about which point said flux conducting retaining means radially oscillates;

a magnet;

pivot means formed by said recess point contacting a fulcrum point, said point being the extended tip of a broad circular base which base contacts said magnet;

first flux conducting elements maintained by said retaining means, central axis of which elements are normal to said recess point and said fulcrum point;

second magnet flux conducting elements operatively connected to said magnet, said second and said first flux conducting elements axially aligned in pairs, said pairs defining at least two movable magnetic flux fields and;

at least one stationary coil interposed in each of said movable magnetic flux fields.

2. According to claim 1 wherein said stationary coils utilize no armatures.

3. According to claim 1 wherein said coils are wound on a spool hub having a wire receiving area which expands from a narrow central portion to a wider outer portion.

4. According to claim 3 wherein said wire receiving area comprises a pair of cones connected at their apexes.

5. According to claim 1 wherein said first and said second flux conducting elements are spherical in shape.

6. According to claim 1 wherein said first and said second flux conducting elements each are semi-spherical in shape.

7. According to claim 1 wherein said first and said second flux conducting elements each are semi-ellipsoid in shape.

8. According to claim 1 wherein said first and said second flux conducting elements each resemble an acorn in shape.

9. According to claim 1 wherein said shank is substantially longitudinally elliptical having a reduced longitudinal thickness center area.

10. According to claim 1 wherein there are four flux conducting elements retained by said flux conducting element retaining means spaced at 90° intervals, opposite elements having a common axis, there being two such common axis intersecting at a point, and wherein said shank has a stylus depending therefrom, a central axis of said stylus and a longitudinal axis of said shank forming a vertical plane maintaining said point.

11. According to claim 1 wherein said flux conducting element retaining means comprise a spheroid fixture having depressions therein, such depressions having central axis normal to said recess point therein, said flux conducting elements residing on depressed surface area thereof.

12. According to claim 1 wherein said flux conducting element retaining means comprise a spherical polygon, said flux conducting elements maintained on surface thereof, central axis of which elements align to a central axis therewithin, said axis being the point of an apex of said recess.

13. According to claim 1 wherein said flux conducting element retaining means comprise a substantially cubical fixture, said first flux conducting elements bonded thereto.

14. According to claim 1 wherein said flux conducting element retaining means comprise a spheroid, which spheroid completely submerges at least two flux conducting elements, central axis of which elements align perpendicular to said recess point and to each other.

15. According to claim 1 wherein said flux conducting element retaining means is a polyhedron.

16. According to claim 1 wherein said flux conducting element retaining means completely submerges said first flux conducting elements.

17. According to claim 1 wherein central axis of said coils is normal to central axis of said first and said second flux conducting elements.

18. According to claim 1 wherein said fulcrum point is magnetically conductive.

19. According to claim 18 wherein said fulcrum point is the first end of a structure having a wide base at a second end thereof which base contact said magnet, and which structure is magnetically conductive.

* * * * *